US005430240A

United States Patent [19]

Okamoto

[11] Patent Number: 5,430,240

[45] Date of Patent: Jul. 4, 1995

[54] PARAMETER CONTROL SYSTEM FOR ELECTRONIC MUSICAL INSTRUMENT

[75] Inventor: Tetsuo Okamoto, Hamamatsu, Japan

[73] Assignee: Yamaha Corporation, Japan

[21] Appl. No.: 72,558

[22] Filed: Jun. 7, 1993

[30] Foreign Application Priority Data

Jun. 8, 1992 [JP] Japan ..... 4-147738

[51] Int. Cl.[6] ..... G10H 7/00

[52] U.S. Cl. ..... 84/600; 84/653; 84/658

[58] Field of Search ..... 84/600, 615, 622, 626, 84/644, 645, 653, 670, 659, 692, 697, 660, 661, 658

[56] References Cited

U.S. PATENT DOCUMENTS

| | | | |
|---|---|---|---|
| 4,962,688 | 10/1990 | Suzuki et al. | 84/600 |
| 4,998,457 | 3/1991 | Suzuki et al. | 84/600 |
| 5,022,303 | 6/1991 | Suzuki . | |
| 5,157,216 | 10/1992 | Chafe | 84/697 |
| 5,245,130 | 9/1993 | Wheaton | 84/658 |
| 5,247,131 | 9/1993 | Okamoto et al. | 84/661 |
| 5,313,010 | 5/1994 | Matsushima et al. | 84/600 |

FOREIGN PATENT DOCUMENTS

| | | |
|---|---|---|
| 2-228698 | 9/1990 | Japan . |
| 3-7992 | 1/1991 | Japan . |

*Primary Examiner*—William M. Shoop, Jr.
*Assistant Examiner*—Jeffrey W. Donels
*Attorney, Agent, or Firm*—Graham & James

[57] ABSTRACT

A parameter control system is employed by an electronic musical instrument when controlling plural musical parameters used for forming a musical tone to be generated. There are provided first and second control devices, each of which is attached to a certain portion of a body of a performer, or each of which is held and operated by the performer. When the first control device is operated by the performer, plural musical parameters are simultaneously controlled in accordance with the operation applied to the first control device. When the second control device is operated by the performer, at least one of plural musical parameters is selectively controlled responsive to the operation applied to the second control device. Preferably, the first control device is an angle sensor which senses a bending angle of the certain portion of the body of the performer, while the second control device is held and operated by a hand of the performer.

17 Claims, 5 Drawing Sheets

PARAMETER CONTROL SYSTEM FOR ELECTRONIC MUSICAL INSTRUMENT

BACKGROUND OF THE INVENTION

The present invention relates to a parameter control system which is used for controlling several kinds of parameters for the musical tones produced from the electronic musical instrument.

In order to control the parameters (hereinafter, referred to as musical parameters) of the musical tones produced from the electronic musical instrument, there is provided a parameter control system which monitors the operating states of the parameter control device so as to control several kinds of parameters of the musical tones. This parameter control device can be attached to the predetermined portion of the body of the performer who plays the electronic musical instrument, or it can be held and operated by the hand of the performer. Such parameter control device provides plural switches (or manual-operable members), one of which is used for controlling the tone pitch of the musical tone, while another one is used for controlling the tone color of the musical tone. In other words, only one kind of the musical parameter is assigned to one switch. This parameter control device can be re-designed such that plural musical parameters are assigned to one switch.

In the former type of the parameter control device in which the predetermined musical parameter is assigned to the predetermined switch, in order to perform the music with a high degree of performability, it is necessary for the performer to simultaneously operate plural switches. This cause inconvenience to the performer because of the complicated performance techniques to be required. Particularly, in case of the parameter control device which is attached to the body of the performer so that the musical parameters are controlled on the basis of the monitored results thereof, some parts of the body of the performer must be moved simultaneously when changing the contents of the musical parameters respectively in accordance with the intention of the performer, However, it is very difficult for the performer to act like that. In contrast, in case of the latter type of the parameter control device in which plural musical parameters are assigned to one switch, it is easy for the performer to simultaneously change the contents of the musical parameters by merely moving a certain part of the body of the performer, Even in this case, however, the changing manner of the contents of the musical parameters is fixed in connection with the predetermined movement of the performer's body, In other words, the contents of plural parameters must be simply changed in accordance with the predetermined changing manner of the parameters. Therefore, it is not possible to selectively change a part of the parameters. In short, there is a drawback in that such device lacks the degree of freedom when performing the music while changing the contents of the musical parameters.

SUMMARY OF THE INVENTION

It is accordingly a primary object of the present invention to provide a parameter control system for the electronic musical instrument in which plural musical parameters can be simultaneously but independently controlled by a simple manual operation.

The present invention is given to accomplish the above-mentioned object, and it relates to a parameter control system which controls plural musical parameters used for forming the musical tones to be produced from the electronic musical instrument.

According to the fundamental configuration of the parameter control system as defined by the present invention, there are provided first and second manual-operable members and a parameter control circuit. Both of the first and second manual-operable members are attached to the body of the performer in advance, or they are held by the hand of the performer. The parameter control circuit is activated responsive to the operations applied to these manual-operable members. When the first manual-operable member is operated, plural musical parameters are controlled simultaneously by the parameter control circuit. When the second manual-operable member is operated, at least one of plural musical parameters is controlled by the parameter control circuit.

In accordance with the operation applied to the first or second manual-operable member, plural musical parameters are simultaneously controlled or at least one of them is selectively controlled by the parameter control circuit. Thus, it is possible to perform the music full of variety of the expressions.

BRIEF DESCRIPTION OF THE DRAWINGS

Further objects and advantages of the present invention will be apparent from the following description, reference being made to the accompanying drawings wherein the preferred embodiment of the present invention is clearly shown.

In the drawings.

DESCRIPTION OF THE PREFERRED EMBODIMENT

Figure 1:
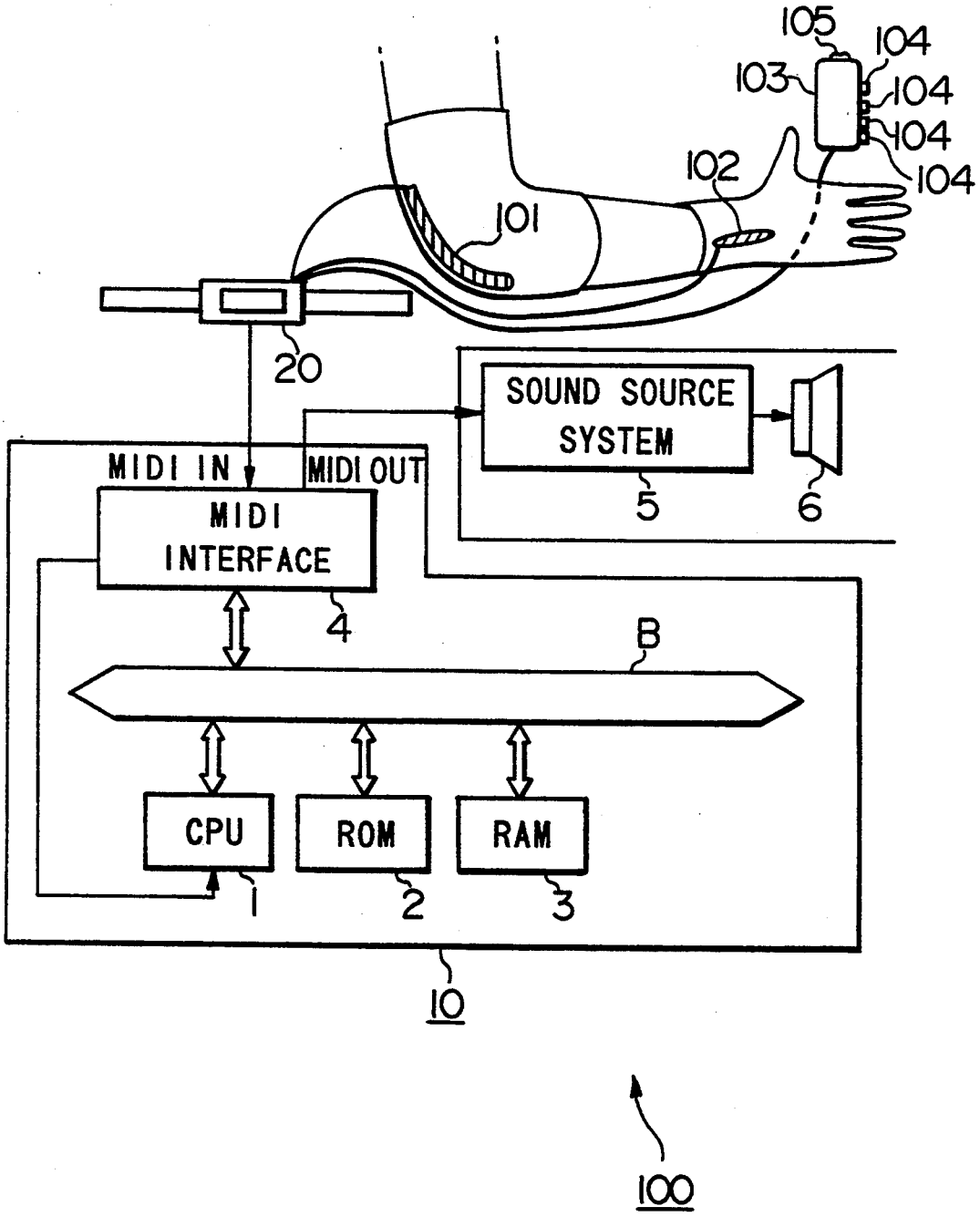
FIG. 1 is a drawing showing a mechanical illustration and an electronic configuration of a parameter control system according to an embodiment of the present invention.

Next, the description will be given with respect to the parameter control system for the electronic musical instrument according to an embodiment of the present invention by referring to the drawings.

A. Configuration

FIG. 1 is a drawing showing the mechanical illustration and electronic configuration of a parameter control system 100 according to an embodiment of the present invention. In FIG. 1, the parameter control system 100 is connected with a sound source system 5, while musical tone signals produced from this sound source system 5 are supplied to a sound system 6, from which the musical tones are actually sounded.

The parameter control system 100 is designed to produce a MIDI signal (i.e., a signal which is formed based on the predetermined standard for the Musical Instruments Digital Interface) on the basis of the operations applied to several manual-operable members shown in FIG. 1. This MIDI signal controls the procedure for forming the musical tone signal in the sound source system 5.

Next, the detailed description will be given with respect to the manual-operable members which are used for producing the MIDI signal. In FIG. 1, numerals 101, 102 designate angle sensors. Herein, the angle sensor 101 is attached to the elbow joint portion of the right arm of the performer, while the angle sensor 102 is attached to the wrist portion of the right hand of the performer. These sensors 101, 102 produce analog signals corresponding to the bending angles applied thereto. Another numeral 103 designates a grip-type device having a shape which can be held (or grasped) by the right hand of the performer. This grip-type device 103 provides four push-button switches 104 and one bend control 105. The push-button switches 104 are respectively depressed by the index finger, middle finger, ring finger and little finger of the right hand of the performer, while the bend control 105 is designed as the rotary control which is rotated by the thumb of the right hand of the performer. A communication portion 20 detects the rotating amount of the bend control 105 and the on/off states of the switches 104. Incidentally, the parameter control system 100 provides another grip-type control and sensors for the left hand of the performer, however, the illustration and description of them are omitted in FIG. 1 for convenience' sake.

The communication portion 20 receives the analog signals outputted from the angle sensors 101,102, while it also receives another analog signal outputted from the bend control 105. Then, the communication portion 20 converts these analog signals into digital signals respectively, and the digital signals are further converted into serial signals which are based on the MIDI standard. Furthermore, the communication portion 20 detects the on/off events of the switches 104 equipped in the grip-type device 103. Then, the detected on/off events are converted into the serial signal which is formed based on the MIDI standard. The serial signal outputted from the communication portion 20 consists of two bytes of data. Within two bytes, the former byte (i.e., one byte of data which are positioned at the higher digit places) represents the status information indicating the manual-operable members (i.e., switches 104 and control 105) which are actually operated by the performer, while the latter byte (i.e., one byte of data which are positioned at the lower digit places) represents the operating amount or on/off events of the manual-operable members. The serial signal outputted from the communication portion 20 is formed based on the signal format (indicating the bit rate, number of bits, etc.) defined by the MIDI standard. However, this serial signal does not necessarily control the electronic musical instrument well at all the time. So, this serial signal is converted into the MIDI signal which can control the electronic musical instrument well. This conversion is made with the help of a parameter creating portion 10.

The parameter creating portion 10 is configured by a central processing unit (CPU) 1, a read-only memory (ROM) 2, a random-access memory (RAM) 3 and a MIDI interface 4 which are connected together by a bus B. The MIDI interface 4 receives the serial signal outputted from the communication portion 20, while it also functions to output an interrupt signal INT toward the CPU 1. Upon the receipt of this interrupt signal INT, the CPU 1 inputs the signal received by the MIDI interface 4 by means of the bus B, thus producing the MIDI signal. Then, the MIDI interface 4 sends the MIDI signal produced by the CPU 1 toward the sound source system 5. The CPU 1 controls several portions of the parameter creating portion 10, and it also functions to produce the MIDI signal on the basis of the serial signals received by the communication portion 20.

Next, the detailed description will be given with respect to the contents and usage of the serial signals respectively received by the communication portion 20. For convenience' sake, each of the serial signals is identified by the symbolic status (or symbol) representing the monitored event or monitored portion of the performer's body.

(1) Serial signals corresponding to angle sensors (e.g., 101) attached to the right elbow portion and left elbow portion of the performer, wherein their status is represented by the symbol "elbow".

The latter one byte of this serial signal represents the bent angle of the right elbow or left elbow of the performer. Then, the tone pitch of the musical tone to be generated is determined by the combination of these serial signals representing the bent angles of the right and left elbows of the performer. In general, a high precision for the sensitivity of the bending angle is not required when indicating the bent angle by use of the serial signal in the present embodiment. So, the whole range of the bending angle of the elbow is roughly divided into three sectors which respectively represent the large angle, intermediate angle and small angle, for example. In this case, the latter one byte of the serial signal represents which sector the bent angle of the elbow belongs to. In this case, by changing the bent angles of the left and right elbows of the performer respectively, it is possible to designate one of nine tone pitches on the basis of the combination of the bent angles of the elbows.

(2) Serial signals corresponding to the push-button switches (e.g., 104) provided for the fingers of the right hand and left hand respectively, wherein their status is represented by the symbol "key-on" or "key-off".

The latter one byte of this serial signal represents the kind of the switch 104 which is operated by the specific finger of the performer. The serial signal which is produced by the key-on event has the status represented by the symbol "key-on", so that this serial signal is used for designating the tone generation of the musical tone having the tone pitch and tone color which are set at the timing of the key-on event. On the other hand, the serial signal which is produced by the key-off event has the status represented by the symbol "key-off", so that this serial signal is used for designating the muting operation of the musical tone which are now sounding. The present embodiment is designed such that the tone pitch determined by the combination of the bent angles of the elbows can be raised up or lowereddown by one or more octaves, or the tone pitch can be ascended or descended by one or more semitones. In order that the tone pitch can be changed as described above, the predetermined number of the switches 104 are provided. Herein, the number of the switches is set corresponding to the combination of the algorithms of the octave-changing method and semitone-changing method which are employed when changing the tone pitch of the musical tone. In this case, the tone pitch is changed by one or more octaves of which number is determined by the algorithm of the octave-changing method, while the tone pitch is hanged by one or more semitones of which number is determined by the algorithm of the semitone-changing method. The CPU 1 discriminates one of the switches 104 which is operated by the specific finger of the performer, and consequently, the tone-pitch changing operation corresponding to the operated switch is to be performed.

(3) Serial signal corresponding to the angle sensor 102 attached to the right wrist of the performer, wherein its status is represented by the symbol "right wrist".

The latter one byte of this serial signal represents the bent angle of the right wrist of the performer, wherein this serial signal is used for controlling the tone color or pitch-bending amount.

(4) Serial signal corresponding to the bend control 105 provided for the right hand of the performer, wherein its status is represented by the symbol "right bend".

The-latter one byte of this serial signal represents the rotating amount of the bend control which is rotated by the thumb of the light hand of the performer, and this serial signal is used for controlling the pitch-bending amount.

(5) Serial signal corresponding to the angle sensor attached to the left wrist of the performer, wherein its status is represented by the symbol "left wrist".

The latter one byte of this serial signal represents the bent angle of the left wrist, wherein this serial signal is used for controlling the tone volume of the musical tone or another tone volume of the noise applied to the musical tone.

(6) Serial signal corresponding to the bend control provided for the left hand of the performer, wherein its status is represented by the symbol "left bend".

The latter one byte of this serial signal represents the rotating amount of the bend control which is rotated by the thumb of the left hand of the performer, and this serial signal is used for controlling the tone volume of the noise applied to the musical tone.

Next, the description will be returned back to FIG. 1. Herein, the foregoing ROM 2 stores several kinds of control programs which are executed by the CPU 1. The RAM 3 contains plural storage areas, which are used as the control registers or flags by the CPU 1. In addition, the specific storage area of the RAM 3 is used as the output buffer which accumulates the MIDI signals to be outputted. Furthermore, this output buffer is configured by plural storage areas in which the MIDI signals to be sequentially outputted by the CPU 1 are sequentially and cyclically written. Therefore, the MIDI signals are cyclically read from the storage areas of the output buffer, and consequently, they are sequentially sent to the sound source system 5. In short, this output buffer functions as the ring buffer. In order to enable such cyclic writing/reading operations to be controlled, the RAM 3 provides an input pointer and an output pointer at the predetermined storage areas. The input pointer points out the storage area in which the MIDI signal should be written, while the output pointer points out the storage area from which the MIDI signal should be read out.

B. Operation

Next, the detailed description will be given with respect to the operation of the parameter control system 100 by referring to the flowcharts shown in FIGS. 2 through 5.

Figure 2:
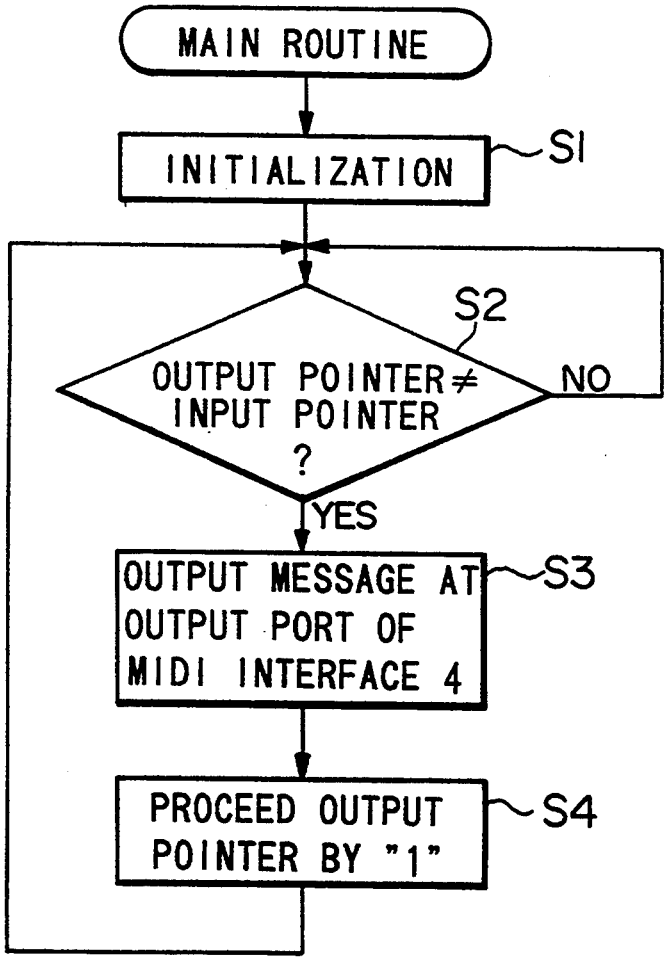
FIG. 2 is a flowchart showing a main routine representing the operations of the present embodiment.

When the power is applied to this parameter control system 100, the CPU 1 starts to execute the processes of the main routine, of which flowchart is shown in FIG. 2. In first step S1 of this main routine, the initialization process is carried out. According to this initialization process, the predetermined initial values are respectively written into the control registers, flags and buffers provided in the RAM 3. For example, this RAM 3 provides four registers respectively denoted by numerals lwrist, rwrist, lbend and rbend. The wrist-state register lwrist stores the bent angle of the left wrist of the performer, while another wrist-state register rwrist stores the bent angle of the right wrist of the performer. Further, the bend-state register lwrist stores the rotating amount of the bend control equipped in the left grip-type device which is held and operated by the left hand of the performer, while another bend-state register rbend stores the rotating amount of the bend control equipped in the right grip-type device which is held and operated by the right hand of the performer. Therefore, the respective initial values are written in these registers lwrist, rwrist, lbend and rbend. In next step S2, it is judged that the value of the input pointer does not coincide with the value of the output pointer, wherein these input and output pointers are provided for the output buffer set in the RAM 3. This process of step S2 is provided to judge whether or not there exists the MIDI signal which has not been outputted yet. In other words, in the state where the input pointer does not coincide with the output pointer, there exists the MIDI signal which is remained in the output buffer. Incidentally, the renewing process for renewing the values of the input and output pointers will be described later. If the judgement result of step S2 is "NO" where the input pointer coincides with the output pointer, the CPU 1 repeats to execute the process of step S2. On the other hand, if the judgement result of step S2 is "YES" where the input pointer does not coincide with the output pointer, the processing of the CPU 1 proceeds to step S3. In step S3, the MIDI signal is read from the storage area designated by the output pointer provided for the output buffer. This MIDI signal is sent to the sound source system 5 via the MIDI interface 4. At this stage, the input pointer is proceeded faster than the output pointer so that the value of the input pointer is larger than the value of the output pointer by one. So, in next step S4, the value of the output pointer is incremented by one. Consequently, the output pointer coincides with the input pointer. Then, the processing of the CPU 1 returns back to the foregoing step S2. At this time, if no MIDI signal to be sent for the sound source system 5 is written in the output buffer, the value of the input pointer is not changed (or proceeded), so that the process of step S2 is repeatedly performer until a new MIDI signal is written in the output buffer so that the input pointer is proceeded. When the new MIDI signal is written in the output buffer, the judgement result of step S2 turns to "YES", and consequently, the aforementioned processes of steps S3, S4 are performed as described above.

Figure 3:
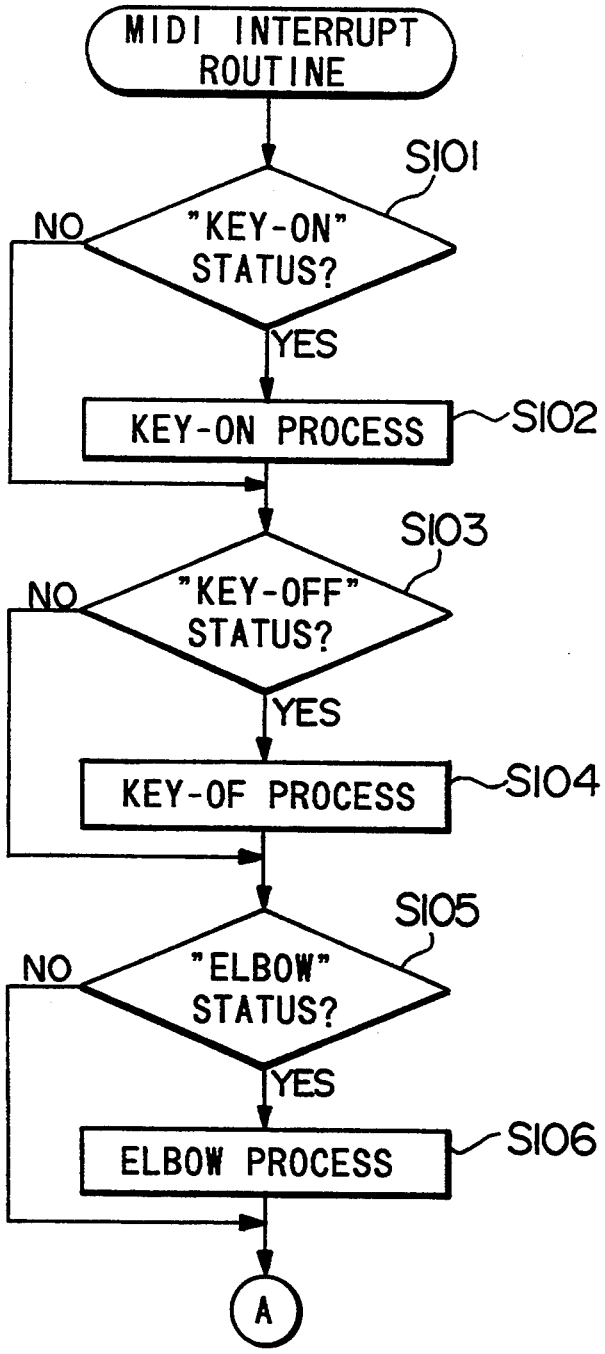
FIGS. 3 through 5 are flowcharts showing a MIDI interrupt routine representing the interrupt operations of the present embodiment.
Figure 4:
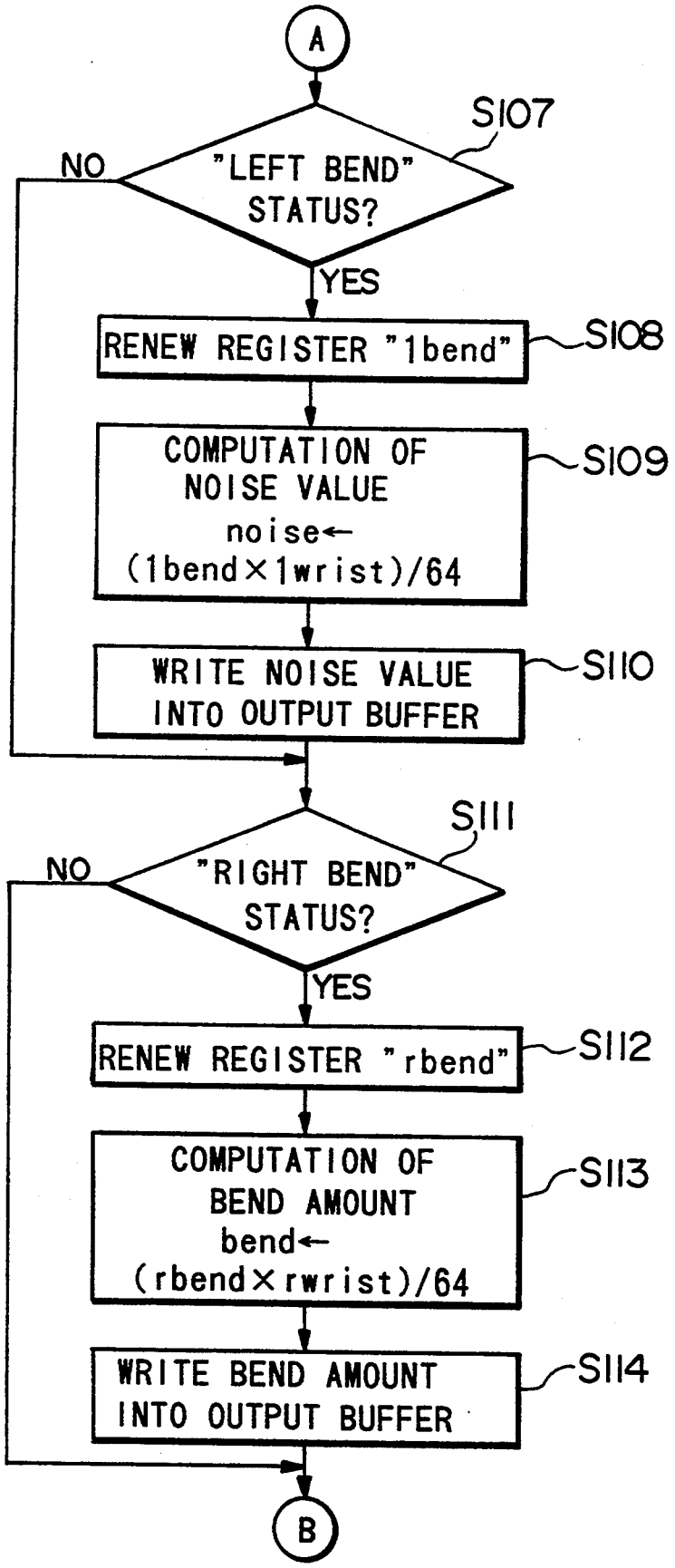
Figure 5:
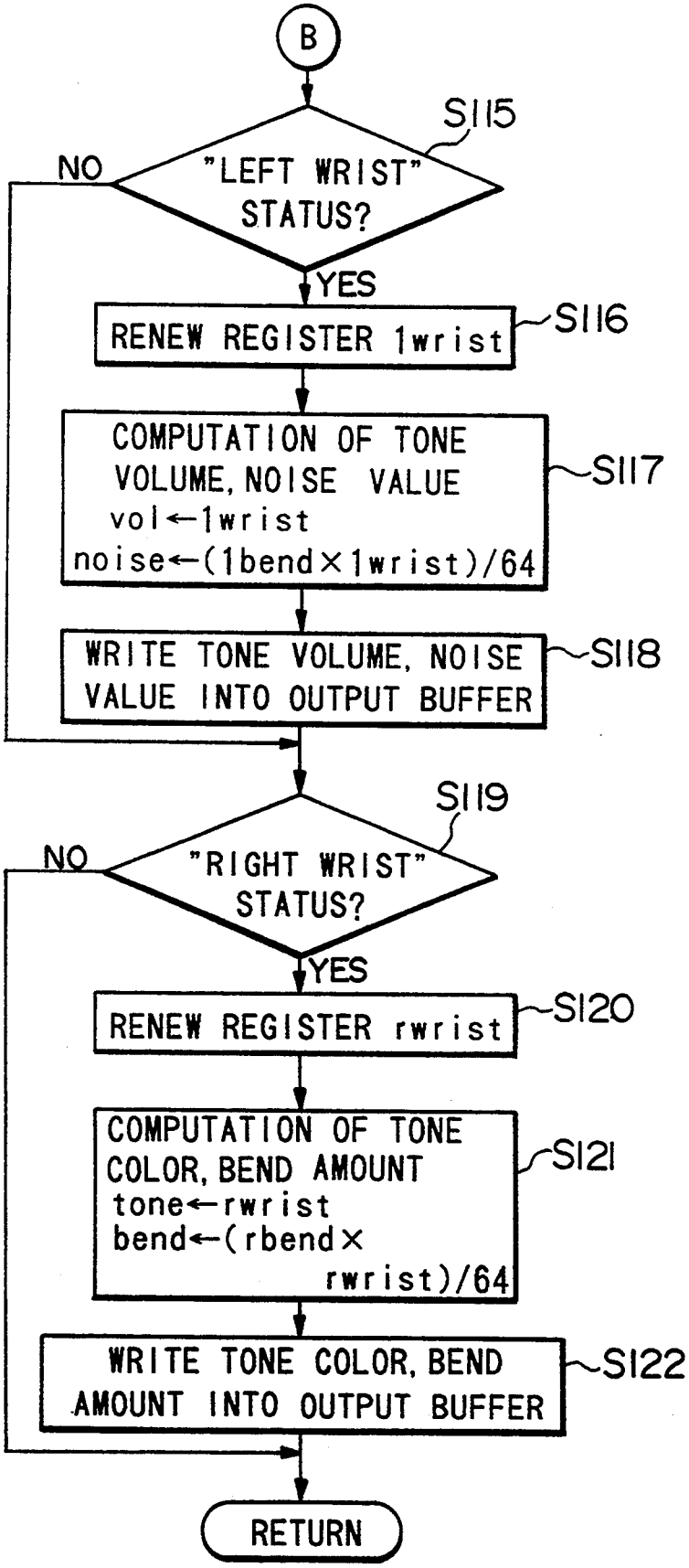

When the performer changes the bending amount of the left elbow, right elbow, left wrist or right wrist, or when the performer operates the grip-type device 103, the corresponding serial signal is outputted from the communication portion 20, and then it is received by the MIDI interface 4. As a result, the MIDI interface 4 produces the interrupt signal INT. Upon the receipt of the interrupt signal INT, the CPU 1 breaks the execution of the process which is now executing. At the same time, the CPU 1 inputs the serial signal received by the MIDI interface 4 via the bus B. Then, the CPU 1 starts to execute the processes of the MIDI interrupt routine, of which flowcharts are shown in FIGS. 3–5. In first step S101 of this MIDI interrupt routine shown in FIG. 3, it is judged whether or not the status represented by the former one byte of the serial signal received by the MIDI interface 4 is identified by the symbol "key-on". If the judgement result of this step S101 is "YES", the processing proceeds to step S102. Thus, the push-button switch which is now depressed on is detected on the basis of the latter one byte of the inputted serial signal, and consequently, the tone-pitch operation corresponding to the depressed switch is performed on the tone pitch which is set at this timing, thus determining the keycode for the musical tone to be generated. Then, the input pointer is incremented by one, and the MIDI signal which designates the tone generation for the musical tone having the determined keycode is written into the storage area of the output buffer designated by the input pointer. Incidentally, the setting manner for the tone pitch will be described later. Further, the keycode to which the tone generation is designated is written into a tone-generation buffer which is set in the RAM 3. Then, the processing proceeds to step S103. On the other hand, when the judgement result of step S101 is "NO", the processing jumps to step S103 without executing the process of step S102. In step S103, it is judged whether or not the status of the inputted serial signal is identified by the symbol "key-off". If the judgement result of this step S103 is "YES", the processing proceeds to step S104. Thus, the input pointer is incremented by one, and then, the MIDI signal which designates the muting operation for the musical tone having the keycode stored in the tone-generation buffer is written into the storage area of the output buffer designated by the input pointer. Then, the processing proceeds to step S105. On the other hand, if the judgement result of step S103 is "NO", the processing jumps to step S105 without executing the process of step S104.

In step S105, it is judged whether or not the status of the inputted serial signal is identified by the symbol "elbow". If the judgement result of this step S105 is "YES", the processing proceeds to step S106 wherein the elbow process is carried out. According to this elbow process, the information representing the bent angles of the left and right elbows of the performer is renewed on the basis of the newly inputted signal. Based on this renewed information, the tone pitch of the musical tone to be generated is set in response to the combination of the bent angles of the left and right elbows. For example, when each of the whole angle ranges of the left and right elbows is divided into three sectors, it is possible to designate one of nine kinds of the tone pitches by the combination of the bent angles of the left and right elbows. Herein, one of the sounds C, D, E, etc. is assigned to each of the combinations of the bent angles of the left and right elbows of the performer. Thereafter, the processing proceeds to step S107 shown in FIG. 4. On the other hand, if the judgement result of step S105 is "NO", the processing directly jumps to step S107 without executing the process of step S106.

In step S107, it is judged whether or not the status of the inputted signal is represented by the symbol "left bend". If the judgement result of this step S107 is "YES", the processing proceeds to step S108 wherein the value of the bend-state register bend is renewed by the latter one byte of the inputted signal. In next step S109, the following computation (1) is performed by use of the current values of the bend-state register lbend and wrist-state register lwrist.

$$noise=(lbend\times lwrist)/64 \quad (1)$$

Incidentally, "noise" in the above equation (1) represents the noise value, whereas the predetermined correction is performed on this noise value such that if the value becomes equal to "128" or more, the value is corrected to be equal to "127" or less. In step S110, the input pointer is incremented by one, and then, the MIDI signal which designates the above-mentioned noise value obtained in step S108 is written into the storage area of the output buffer designated by the input pointer. When receiving the MIDI signal designating the noise valise, the sound source system 5 is controlled such that the noise corresponding to the noise value is added to the musical tone signal. Thus, it is possible to reproduce the breath noises and the like which are applied to the sounds of the wind instrument. For this reason, it is possible to generate the musical tones of which characteristics are closer to those of the musical sounds produced by the non-electronic musical instrument. Thereafter, the processing proceeds to step S111. On the other hand, if the judgement result of step S107 is "NO", the processing directly jumps to step S111 without executing the processes of steps S108 through S110.

In step S111, it is judged whether or not the status of the inputted signal is identified by the symbol "right bend". If the judgement result of this step S111 is "YES", the processing proceeds to step S112 wherein the value of the bend-state register rbend is renewed by the latter one byte of the inputted signal. In next step S113, the following computation (2) is performed by use of the current values of the bend-state register rbend and wrist-state register rwrist, thus obtaining the bend value represented by "bend".

$$bend=(rbend\times rwrist)/64 \quad (2)$$

Incidentally, the bend value which is obtained by the above equation (2) is corrected such that if the value becomes equal to "128" or more, the value is corrected to be equal to "127" or less. In next step S114, the input pointer is incremented by one, and then, the MIDI signal which designates the above-mentioned bend value is written into the storage area of the output buffer which is designated by the input pointer. Responsive to the bend value designated by the MIDI signal, the sound source system 5 slightly alters the tone pitch which is determined by the combination of the bent values of the left and right elbows and the operated switch 104 of the grip-type device. Thereafter, the processing proceeds to step S115 shown in FIG. 5. On the other hand, if the judgement result of step S111 is "NO", the processing directly jumps to step S115 without executing the processes of step S112 through S114.

In step S115, it is judged whether or not the status of the inputted signal is identified by the symbol "left wrist". If the judgement result of this step S115 is "YES", the processing proceeds to step S116 wherein the value of the wrist-state register lwrist is renewed by the latter one byte of the inputted signal. In next step S117, the contents of the wrist-state register/wrist is written into a volume register "vol". Further, the following computation (3) is performed by use of the values of the wrist-state register lwrist and bend-state register lbend, thus obtaining a noise value represented by "noise".

$$noise=(lbend\times lwrist)/64 \quad (3)$$

Incidentally, this noise value is corrected such that if the value becomes equal to "128" or more, the value is corrected to be equal to "127" or less. In next step S118, the input pointer is incremented by one. Then, the MIDI signal which corresponds to the contents of the volume register vol so as to designate the tone volume is written into the storage area of the output buffer designated by the input pointer. Responsive to the value of the MIDI signal, the sound source system 5 alters the tone volume of the musical tone which is now generating from the sound system 6. Next, the input pointer is further incremented by one, so that the MIDI signal which designates the aforementioned noise value is written into the storage area of the output buffer designated by this input pointer. Thereafter, the processing proceeds to step S119. On the other hand, if the judgement result of step S115 is "NO", the processing directly jumps to step S119 without executing the processes of steps S116 through S118.

In step S119, it is judged whether or not the status of the inputted signal is identified by the symbol "right wrist". If the judgement result of this step S119 is "YES", the processing proceeds to step S120 wherein the value of the wrist-state register rwrist is renewed by the latter one byte of the inputted signal. In next step S121, the renewed contents of the wrist-state register rwrist is written into a tone-color register which is represented by the term "tone". Further, the following computation (4) is performed by use of the current values of the wrist-state register rwrist and bend-state register rbend, thus obtaining a bend value which is represented by "bend".

$$bend=(rbend\times rwrist)/64 \quad (4)$$

Incidentally, the above bend value is corrected such that if the value becomes equal to "128" or more, the value is corrected to be equal to "127" or less. In next step S122, the input pointer is incremented by one, and consequently, the MIDI signal which corresponds to the contents of the tone-color register "tone" so as to designate the tone color for the musical tone to be generated is written into the storage area of the output buffer designated by the input pointer. Upon the receipt of this MIDI signal which corresponds to the contents of the tone-color register "tone", the sound source system 5 changes the cut-off frequency of the filter provided therein so as to control the tone color to be slightly altered, for example. Next, the input pointer is further incremented by one, and then, the MIDI signal which designates the bend value (represented by "bend" in the foregoing equation (4)) is written into the storage area of the output buffer designated by the input pointer. Thereafter, the execution of the MIDI interrupt routine (of which processes are represented by the flowcharts shown in FIGS. 3 through 5) is completed, so that the processing returns back to the main routine of which execution had been once broken before. On the other hand, if the judgement result of step S119 is "NO", the processing directly returns back to the main routine without executing the processes of step S120 through S122.

As described above, the MIDI signal is created responsive to the operation effected on each of the manual-operable members, and then, the MIDI signals are sequentially written into the storage areas of the output buffer. As a result, the value of the input pointer is normally higher than the value of the output pointer, and consequently, the MIDI signals are sequentially read from the storage areas of the output buffer and then sent to the sound source system 5 (see step S3).

By use of the above-mentioned parameter control system 100, it is possible to carry out the following musical-performance control operations.

(1) The amount of the noise applied to the musical tone can be controlled by rotating the bend control by the left thumb of the performer.

(2) By adjusting the bending angle of the left wrist of the performer, it is possible to simultaneously control both of the tone volume of the musical tone and the amount of the noise applied to the musical tone. In general, there is established a correlation between the tone volume of the musical tone and the noise sound applied to the musical tone. Based on this correlation, the present embodiment can simplify the operation of the performer who intends to simultaneously control both of them.

(3) By rotating the bend control by the right thumb of the performer, it is possible to control the bend value applied to the tone pitch of the musical tone when performing the pitch-bend operation.

(4) By adjusting the bending angle of the right wrist of the performer, it is possible to simultaneously control the tone color of the musical tone and the bend value applied to the tone pitch of the musical tone. In general, there is established a correlation between the pitch-bend amount and tone color of the musical tone. Thus, based on this correlation, the present embodiment can simplify the operation of the performer who intends to control both of them.

(5) By bending the left wrist of the performer, it is possible to simultaneously change the tone volumes of the musical tone and noise in the predetermined volume-changing direction (i.e., volume-increasing direction or volume-decreasing direction). Moreover, by simultaneously rotating the left-side bend control while bending the left wrist of the performer, it is possible to further change the noise amount in the predetermined volume-changing direction, thus greatly changing the noise applied to the musical tone.

(6) In reverse to the above-mentioned operation (5), by changing the bending direction of the left wrist to be reverse to the rotating direction of the bend control when controlling the noise amount, the variation of the noise amount which is caused by bending the left wrist can be canceled by the variation of the noise amount which is caused by rotating the bend control. In this case, since the variation of the noise amount is canceled, it is possible to alter the tone volume of the musical tone only.

(7) In this operation, both of the bend amount and tone color are altered in the predetermined direction by bending the right wrist of the performer, while the bend amount is further altered in the same direction by further rotating the right-side bend control. Thus, it is possible to greatly change the bend amount applied to the tone pitch of the musical tone.

(8) In reverse to the above-mentioned operation (7), the bending direction of the right wrist is changed to be reverse to the rotating direction of the bend control when controlling the bend amount. In this case, the variation of the bend amount which is caused by bending the right wrist can be canceled by the variation of the bend amount which is caused by rotating the bend control. Thus, it is possible to change the tone color of the musical tone only.

In the present embodiment described heretofore, plural operating amounts applied to plural manual-operable members are subjected to the calculation containing the multiplication and division. However, it is possible to modify the present embodiment such that plural operating amounts are subjected to another calculation containing the addition and subtraction so as to calculate the musical parameter. For example, the foregoing calculation (1) can be rewritten as follows:

$$noise = lbend + lwrist - 64$$

Or, it is possible to provide a two-dimensional table which stores the values of the musical parameters each selected by the combination of the operating amounts of two manual-operable members. In this case, the certain musical parameter is determined in connect/on with the operation applied to each of the manual-operable members by use of the above two-dimensional table. Further, it is possible to provide the function which uses the operating amount of the manual-operable member as the independent variable. Furthermore, it is possible to provide the predetermined mathematical operation which is effected on the value of the function so as to compute the desirable musical parameter. Or, it is possible to provide a two-dimensional table, by which the musical parameter is determined in response to the combination of the values of the functions. Moreover, it is possible to replace the foregoing grip-type device with the sensor device which senses the bending motions of the fingers of the performer. Or, it is possible to modify the present embodiment such that three parameters are simultaneously controlled by one manual-operable member, while two of three parameters are controlled by another manual-operable member. In short, it is possible to arbitrarily change the number of the parameters which are controlled by one manual-operable member.

Lastly, this invention may be practiced or embodied in still other ways without departing from the spirit or essential character thereof as described heretofore. Therefore, the preferred embodiment described herein is illustrative and not restrictive, the scope of the invention being indicated by the appended claims and all variations which come within the meaning of the claims are intended to be embraced therein.

What is claimed is:

1. A parameter control system for controlling plural musical parameters used for determining a musical tone to be generated, said parameter control system comprising:

first and second control devices each of which is either attached to a body of a performer or is held by a hand of the performer wherein the first control device includes at least one Operation member; and a parameter control means for simultaneously controlling plural musical parameters in accordance with operation of a respective one of said at least one operation member of the first control device;

wherein said parameter control means selectively controls a value of at least one of said plural musical parameters in accordance with operation of said second control device.

2. A parameter control system as defined in claim 1 wherein at least one of said first and second control devices is attached to a portion of the body of the performer so as to detect an angle of the portion of the body of the performer.

3. A parameter control system as defined in claim 1 wherein at least one of said first and second control devices is held and operated by the performer so as to detect an operation made by a finger of the performer.

4. A parameter control system as defined in claim 1 further comprising:

parameter creating means which creates said musical parameters on the basis of information representing the operation of at least one of said first and second control devices.

5. A parameter control system as defined in claim 1 wherein:

one of said musical parameters controlled by said first control device designates a tone color of the musical tone; and said one of said musical parameters controlled in accordance with said operation of said second control device designates a bend value applied to the tone pitch of the musical tone.

6. A parameter control system as defined in claim 1 wherein:

one of said musical parameters controlled by said first control device designates a tone volume of the musical tone; and said one of said musical parameters controlled in accordance with said operation of said second control device designates an amount of noise applied to the musical tone.

7. A parameter control system for controlling first and second musical parameters used for determining a musical tone to be generated, said parameter control system comprising:

first and second control devices each of which is either attached to a body of a performer or is held by a hand of the performer, wherein the first control device includes at least one operation member; and a parameter control means for controlling said first musical parameter in accordance with an operation applied to one of the at least one operation members of said first control device when said first control device is operated by the performer, said parameter control means controlling a value of said second musical parameter when at least one of said at least one operation member and the second control device is operated by the performer.

8. A parameter control system as defined in claim 7 wherein said first musical parameter designates a tone volume of the musical tone, and said second musical parameter designates an amount of noise applied to the musical tone.

9. A parameter control system as defined in claim 7 further comprising:

parameter creating means for creating said musical parameters on the basis of information representing the operation of at least one of said first and second control devices.

10. A parameter control system as defined in claim 7 wherein said first musical parameter designates a tone color of the musical tone, and said second musical parameter designates a bend value applied to the tone pitch of the musical tone.

11. A parameter control system as defined in claim 5 wherein said pārameter control means simultaneously controls said first and second musical parameters when said first control device is operated by the performer.

12. A parameter control method employed by an electronic musical instrument, which musical instrument includes first and second control devices capable of being operated by a performer for controlling plural musical parameters used for determining a musical tone to be generated, wherein said first control device includes at least one operation member, said parameter control method comprising the steps of:

detecting operations of said first and second control devices;

operating one of said at least one operation member of said first control device;

simultaneously controlling said plural musical parameters in accordance with the operation of said one of said at least one operation member of said first control device; and selectively controlling a value of at least one of said plural musical parameters in accordance with an operation of said second control device.

13. A parameter control method as defined in claim 12 further comprising the step of:

creating said musical parameters on the basis of information representing the operation of at least one of said first and second control devices.

14. A parameter control method employed by an electronic musical instrument, which musical instrument includes first and second control devices capable of being operated by a performer when controlling first and second musical parameters used for determining a musical tone to be generated wherein said first control device includes at least one operation member, said parameter control method comprising the steps of:

detecting operations of said first and second control devices, each of which is attached to a body of a performer or is held by the performer; and controlling said first musical parameter in accordance with an operation of one of said at least one operation member of said first control device; and controlling a value of said second musical parameter when least one of said one of said at least one operation member and second control device is operated by the performer.

15. A parameter control method as defined in claim 14 wherein said first musical parameter designates a tone volume of the musical tone, and said second musical parameter designates an amount of noise applied to the musical tone.

16. A parameter control method as defined in claim 14 wherein said first and second musical parameters are simultaneously controlled when said first control device is operated by the performer.

17. A parameter control system as defined in claim 14 wherein said first musical parameter designates a tone color of the musical tone, and said second musical parameter designates a bend value applied to the tone pitch of the musical tone.

* * * * *